US005402621A

United States Patent [19]

Weiss

[11] Patent Number: 5,402,621

[45] Date of Patent: Apr. 4, 1995

[54] PROCESS AND A DEVICE FOR THE CLEANING OF CLOSING HEADS FOR THE CLOSING OF VESSELS WITH CROWN CAPS

[75] Inventor: Wilhelm Weiss, Lappersdorf, Germany

[73] Assignee: Krones AG Hermann Kronseder Maschinenfabrik, Neutraubling, Germany

[21] Appl. No.: 937,902

[22] PCT Filed: Aug. 19, 1991

[86] PCT No.: PCT/EP91/01572

§ 371 Date: Oct. 16, 1992

§ 102(e) Date: Oct. 16, 1992

[87] PCT Pub. No.: WO92/05104

PCT Pub. Date: Apr. 2, 1992

[30] Foreign Application Priority Data

| | | | |
|---|---|---|---|
| Sep. 15, 1990 | [DE] | Germany | 40 29 364.5 |
| Nov. 13, 1990 | [DE] | Germany | 40 36 135.7 |
| Apr. 2, 1991 | [DE] | Germany | 41 10 456.0 |

[51] Int. Cl.[6] ..... B65B 65/00; B65B 7/28

[52] U.S. Cl. ..... 53/396; 53/488; 53/167; 53/347

[58] Field of Search ..... 53/167, 488, 341, 342, 53/343, 347, 344, 306, 308, 328, 396; 141/90, 91

[56] References Cited

U.S. PATENT DOCUMENTS

| | | | |
|---|---|---|---|
| 4,389,833 | 6/1983 | Knabe | 53/342 X |
| 4,527,377 | 7/1985 | Hayashi et al. | 53/167 |
| 5,040,354 | 8/1991 | Ahlers et al. | 53/342 X |
| 5,150,558 | 9/1992 | Bernhard | 53/343 X |

FOREIGN PATENT DOCUMENTS

| | | |
|---|---|---|
| 2648125 | 12/1990 | France . |
| 2740440 | 1/1979 | Germany . |
| 2948633A1 | 6/1981 | Germany . |
| 3227244C1 | 1/1984 | Germany . |

*Primary Examiner*—Linda B. Johnson

*Attorney, Agent, or Firm*—Finnegan, Henderson, Farabow, Garrett & Dunner

[57] ABSTRACT

A process and device for the cleaning of closing heads in a device for closing vessels with crown caps, the closing head having a die guided in a guide bore for pressing a crown cap against the opening of a vessel to be closed, the die being movable relative to the closing head against the force of a spring disposed in an inner space of the closing head and a gap space being provided between the die and the wall of the guide bore. A flushing agent can then be guided through a flow opening connected with the inner space, so that the agent flows through the inner space with the spring means and the gap space between the die and the wall of the guide bore, whereby a complete cleaning of all parts of the closing head is achieved.

18 Claims, 3 Drawing Sheets

Figure 4:
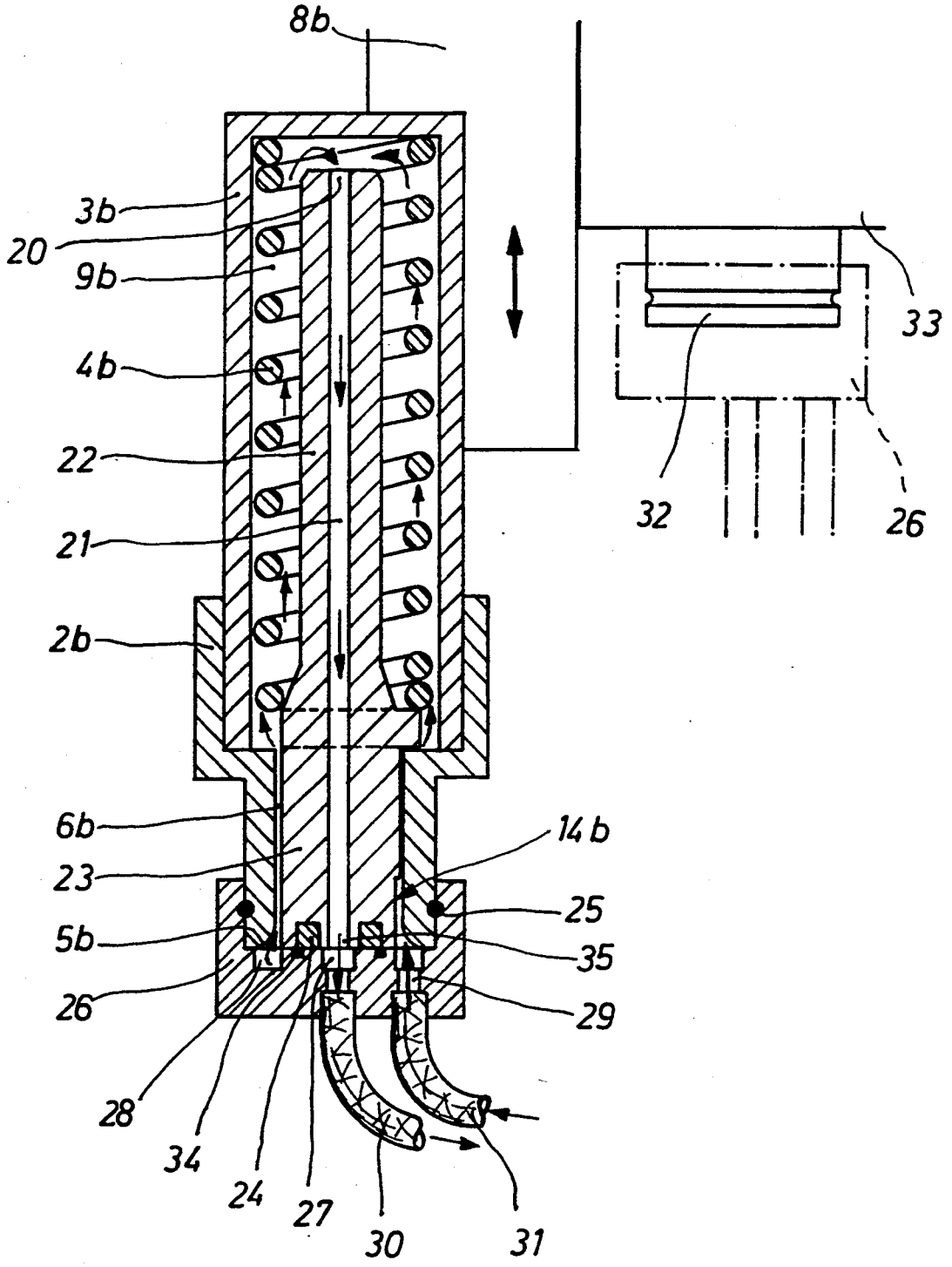

Fig. 1
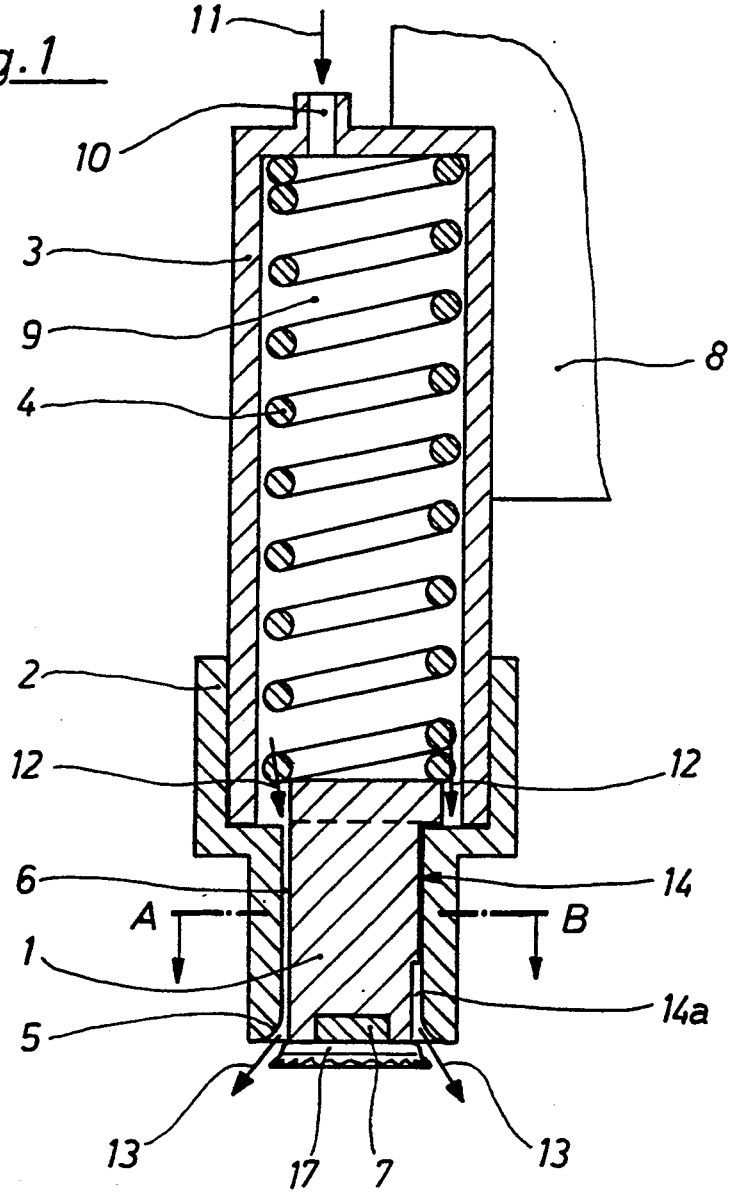
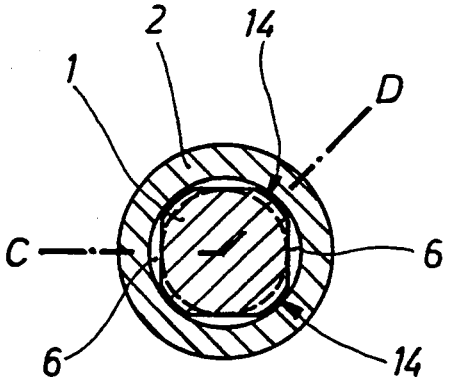
Fig. 2
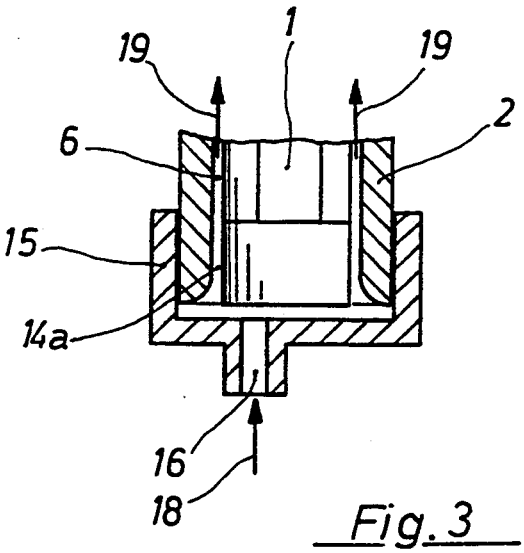
Fig. 3

PROCESS AND A DEVICE FOR THE CLEANING OF CLOSING HEADS FOR THE CLOSING OF VESSELS WITH CROWN CAPS

SPECIFICATION

The invention relates to a process for the cleaning of closing heads in a device for the closing of vessels with crown caps and a device suited for its implementation.

Devices for the closing of vessels such as bottles with crown caps or similar flanged caps are used in particular in the beverage industry, where they are connected downstream of filling devices. The closing devices mostly have several closing heads, which are disposed revolvingly in the style of a carrousel and are fed with crown caps during the revolution. The closing of the bottles with crown caps is effected when the closing heads are aligned to the openings of the bottles which are conveyed on a path corresponding to the circular path of the closing heads.

During the course of the operation of the closing device it is inevitable that liquid and foam residues get onto and into the closing heads and form there nutritive media for harmful germs or putrefaction foci. Thus, there is the danger that the beverage in the bottles or the like is contaminated by putrefaction products, bacteria, fungi, germs, etc., which may have a very detrimental effect on the taste, the wholesomeness and in particular on the keeping quality of the filled beverage. Accordingly, it is customary to clean the closing heads of a closing device continuously or at certain intervals. It is desirable that the expenditure necessary for cleaning is as small as possible and that no dismounting of the closing device is necessary for this.

It is known from DE-AS 27 40 440 to spray the closing heads at their end surfaces facing the vessel opening for cleaning them.

A process of the type mentioned at the beginning is disclosed in DE-PS 32 27 244, in which a flushing liquid is allowed to enter the gap space between die and guide bore through flow openings opening into this space, which is drained downwardly out of the gap space and flushes the same at least partly.

It is an object of the invention to provide a process of the type mentioned at the beginning for the cleaning of closing heads which is improved as compared with the prior art and a device suited for its implementation.

A contamination of the filled liquid by detrimental germs in the closing head can be avoided to the greatest extent with the process according to the invention, since all inner areas of the closing head in which putrefaction foci or nutrient media can be formed are covered by the flushing. So far, there was the danger of contamination by germs which were formed in the inner spaces of the closing heads with the spring means on a long-term basis.

In an embodiment of the invention the flushing agent can be allowed to enter the inner space through the flow opening and then flow out of the closing head through the gap space between the die and the wall of the guide bore.

In another embodiment a reverse flow path may be provided, for which purpose a cap is placed onto the end of the closing head, which faces the vessel opening, a hollow space being formed between the inner wall of the cap and the end of the closing head, into which the gap space between the die and the wall of the guide bore opens. In this embodiment there is the advantage that the end surfaces of the die, the closing cone, etc. facing the vessel opening are thoroughly flushed and cleaned.

According to another development of the invention it may be provided that the gap space between the die and the wall of the guide bore is enlarged at the end of the die facing the vessel opening, and a flow duct is provided between the gap space and the inner space. This embodiment has the advantage that the lower end portion of the closing head, which is subjected to the greatest risk of soiling, is subjected to an especially effective cleaning, since a settling of dirt is prevented, on the one hand, by an enlargement of the gap space and, on the other, by a thorough flushing of this gap space.

Four examples of embodiment of the invention will be explained in the following by means of the drawing.

Figure 5:
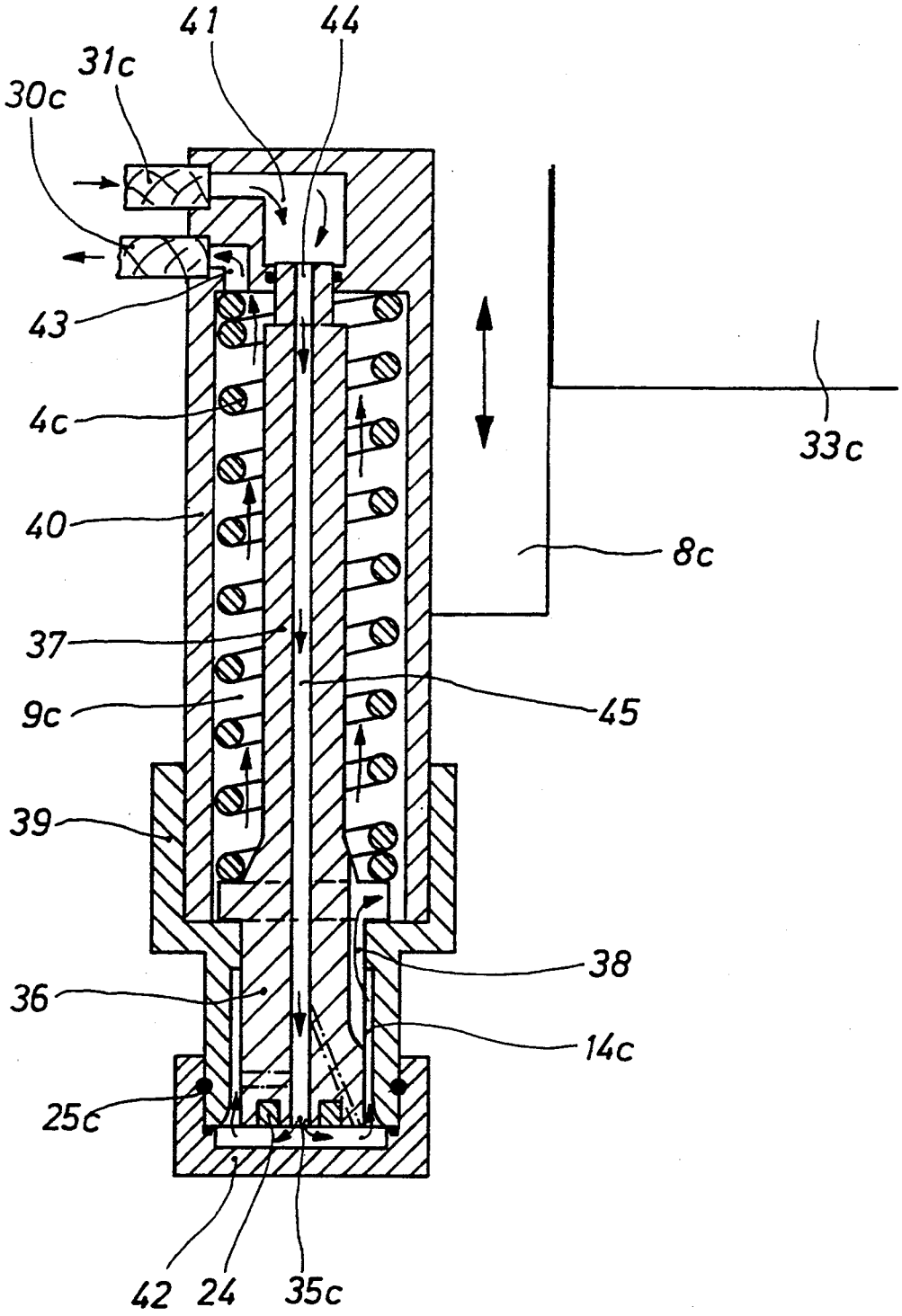

FIG. 1 is a vertical section, taken along the line C–D of FIG. 2, through a closing head that can be used in the process according to the invention, FIG. 2 is a sectional view taken along the line A–B of FIG. 1, FIG. 3 is a partial section through another closing head that can be used in the process according to the invention, FIG. 4 is a vertical section through a further closing head that can be used in the process according to the invention, and FIG. 5 is a vertical section through yet a further closing head that can be used in the process according to the invention.

A die serving as ejector and holding-down means is designated with the reference numeral 1 in FIG. 1, in whose lower end surface a magnet 7 for holding a crown cap 17 is embedded. The die 1 is substantially guided by a cylindrical guide bore formed by a sleeve 2. At the end not facing the crown cork 17, the die 1 is enlarged and has an abutment surface, against which a spring means 4 in the form of a helical spring abuts. The helical spring is disposed in a sleeve 3, which, together with the sleeve 2, forms the inner space 9 of the closing head, the spring abutting against an upper end wall of the sleeve 3 with its upper end. A flow opening 10 for a flushing agent is disposed in this upper end wall of the sleeve. The sleeves 2 and 3 fitted into each other are firmly connected with each other and can be moved together in vertically controlled fashion by actuating means (not shown) to which they are connected via a connection element 8. The sleeves 2, 3 are moved down against a bottle to press the crown cork 17 onto the bottle's opening (not shown), the spring 4 being compressed in the process. In order to fasten the crown cork 17 to the bottle opening, the sleeves 2, 3 continue to move in such fashion that the edge of the crown cork is flanged by the closing cone 5 formed at the lower end of the sleeve 2.

A gap space 14 is provided between the outer wall of the die 1 and the inner wall of the guide bore of the sleeve 2 in which the die 1 is guided. The gap space 14 is enlarged at the end of the die 1, which faces the crown cork 17 by reducing the diameter of the die 1. This enlarged portion of the gap space is designated **14*a***.

The otherwise cylindrical circumference of the die 1 is provided with several flattenings extending in the longitudinal direction so that a polygon-like cross-section is formed (cf. FIG. 2). These flattenings form flow ducts 6 in the sleeve 2 together with the interior of the guide bore, which connect the inner space 9 with the gap spaces 14, 14a.

A flushing agent, preferably a liquid such as a disinfectant is introduced into the upper flow opening 10 in accordance with the direction of the arrow 11 for cleaning the closing head according to FIGS. 1 and 2. The flushing agent flows through the entire inner space 9 and then enters the flow ducts 6 or the gap spaces 14 in accordance with the arrows 12 and subsequently the enlarged gap space 14a, before it leaves the closing head in accordance with the arrows 13 at the lower end of the gap space 14a. (The crown cap 17 is only drawn in FIG. 1 to illustrate the functioning of the closing head. During cleaning, the closing heads are in general not provided with a crown cap.) During flushing of the closing head in accordance with the arrows 11 to 13, a thorough throughflow and cleaning of all inner spaces is carried out, in which putrefaction foci, nutrient media for detrimental germs, etc. might form during operation of the closing means in which the shown closing head is integrated.

In the embodiment of FIG. 3, a cup-like cap 15 is fastened to the lower end of the sleeve 2 of the closing head which otherwise corresponds to the closing head according to FIGS. 1 and 2, in whose bottom a flow opening 16 is provided. A hollow space is formed between the lower wall of the cap 15 and the lower end of the closing head, into which the enlarged gap space 14a opens. It is thus possible using cap 15 to allow the flushing agent to flow through the closing head in a reverse direction, namely in accordance with the arrows 18 and 19 upwardly from below with the flow opening 16 acting as inlet and the flow opening 10 as the outlet. The advantage of this is that the lower end face or surfaces of the closing head facing the crown cork 17 are flushed and cleaned especially thoroughly. This thorough cleaning is of course also the case if flow opening 10 is the inlet and the flow opening 16 the outlet. In the embodiment of the process according to the invention as it was described with respect to FIGS. 1 and 2, an additional flushing phase would have to be carried out for the thorough cleaning of these surfaces, during which the face of the closing heads are sprayed from below.

The closing head according to FIG. 4 corresponds partly to the closing head according to FIG. 1, the corresponding elements being designated with the same reference numerals and the index b. The following is different: The die 23 guided in the sleeve 2b with the formation of an enlarged gap space 14b and flow ducts 6b connecting it with the inner space 9b has a tubular projection 22 at the side facing the inner space 9b, which ends shortly below the upper end wall of the sleeve 3b. The outer diameter of the projection 22 is smaller than the inner diameter of the spring means 4b so that a sufficient flow cross-section remains free. A flow opening 20 is formed at the free upper end of the projection 22, opposite the die 23, which is connected with the lower end surface or face of the die 23 by means of a flow duct 21 extending within the projection 22 and the die 23 or opens there into the open air. The flow duct 21 extends concentrically to the central axis of the die 23. Accordingly, the magnet 24 embedded in the lower end surface of the die 23 is of an annular design and disposed concentrically to the opening of the flow duct 21.

If the closing head described above is to be cleaned, a cup-shaped cap 26 is fastened to the lower end of the sleeve 26 provided with corresponding grooves by means of pins or clamps 25. The cap 26 has a continuous flow opening 27 in the center, which directly adjoins the flow duct 21 in the die 23. An upwardly open annular groove 28 is formed concentrically to this flow opening 27 in the interior of the cap 26, which directly adjoins the gap space 14b. A further continuous flow opening 29 opens into this annular groove 28. The two flow openings 27 and 29 in the cap 26, which are separated from each other by a sealing ring 34, are connected with a means and a feeder discharge respectively for a liquid flushing agent via tubes 30, 31. The flushing agent is e.g. fed through the tube 31 and the flow opening 29 under pressure, penetrates through the flow ducts 6b and the space gap 14b and flows upwardly into the inner space 9b. It flows through space 96 flushing the spring means 4b up to the upper end, penetrates into the flow opening 20 and flows downwardly through the flow duct 21. The flushing agent is then drained through the flow opening 27 and the tube 30 at the lower flow opening 35 of the flow duct 21. This direction of flow is indicated by arrows in FIG. 4. A reverse flowing through the closing head is of course also possible.

After the completion of the cleaning process, the cap 26 is removed from the sleeve 2b without detaching the tubes 30, 31 and is then slipped onto a receiver 32 provided with a corresponding annular groove. This receiver 32 is fastened to a carrier 33 fixed in its height, which guides the connection element 8b in vertically movable fashion. During normal operation of the closing device, the cap 26 can remain in this parked position.

The closing head according to FIG. 5 corresponds partly to the closing head according to FIG. 4; corresponding elements being provided with the same reference numerals and the index c. The following is different:

The projection 37 of the die 36 extends out of the inner space 9c with its extended upper end being in guided liquid-tight fashion in the upper end wall of sleeve 40, the flow opening 44 of the projection communicating with a flow chamber 41 formed within the sleeve 40. The tube 31c, through which the flushing agent can be fed or drained, is connected to the flow chamber 41. The flow opening 44 is connected with the flow opening 35c formed at the lower front side of the die 36 by means of the flow duct 45 formed within the projection 37 and the die 36.

The casing of the die 36 is substantially cylindrical and provided, uniformly distributed across its circumference, with several longitudinal grooves extending in the axial direction. They form flow ducts 38 through which the gap space 14c is connected to the inner space 9c. The gap space 14c is formed by the casing of the die 36 and by a portion with enlarged diameter of the guide bore for the die 36 in the sleeve 39.

The tube 30c is connected to the flow opening 43 formed in the sleeve 40 at the upper end of the inner space 9c, which extends rectangularly, through which the flushing agent can be drained or fed.

The cap 42 fastened to the lower end of the sleeve 39 in liquid-tight fashion does not have any flow openings leading into the open air. It forms a hollow space with its inner surface disposed at a distance from the front side or face of the die 36, into which both the flow opening 35c in the die 36 and the gap space 14c between the die 36 and its guide bore open.

If the flushing liquid is fed through the upper tube 31c as shown in FIG. 5 by an arrow, the flowthrough of all areas of the closing head indicated by arrows results. The flushing liquid flows first of all through the flow duct 45 downwardly to the front side of the die 36 and into the cap 42, where it flushes the die 36 and the gap space 14c thoroughly and then flows upwardly through the ducts 38 and inner space 9c, where it is drained through the flow opening 43 and the tube 30c.

In similar fashion as in the closing head according to FIG. 1, an effective cleaning can also be carried out in the closing head according to FIG. 5 without cap, since the inner space 9c and the gap space 14c can be flushed by feeding flushing liquid via the tube 30c and the flow opening 43, whereafter the flushing liquid flows into the open air. In addition, the interior of the projection 37 and of the die and the central portion of its front surface can be flushed by feeding flushing liquid via the tube 31c and the flow opening 44.

As outlined in FIG. 5 in dot-dashed lines, the flow duct 45 can end additionally or exclusively at one or several points of the circumference of the die 36 in the area of the die 36. The lower portion of the flow duct 45 can also be branched into several obliquely directed partial ducts, which form several flow openings at the lower front side of the die 36.

I claim:

1. A process for cleaning the closing head of a device for closing vessels with crown caps wherein the closing head includes a die slidably mounted in a guide bore of the head and having a die face at its lower end, said die face being adapted to press a crown cap over an opening of a vessel to be closed as the head is moved relative to the vessel, the die being movable in the guide bore relative to the closing head against the force of a spring means which is located in an interior space of the closing head, a gap space being provided between the die and an inner wall of the guide bore that communicates with said interior space and a first flow opening being provided opposite the die that communicates with said interior space, the process comprising flowing a flushing agent through the first flow opening, through the interior space containing the spring means and past and around said spring means and through the gap space between the die and the inner wall of the guide bore.

2. The process of claim 1, wherein said first flow opening is located in a wall of the closing head.

3. The process of claim 2, wherein the flushing agent is fed to the first flow opening so that the agent flows first through the interior space and past and around the spring means and then through the gap space between the die and the inner wall of the guide bore.

4. The process of claim 3, wherein the flushing agent is discharged after flowing through the gap space.

5. The process of claim 2, including securing a closing cap to a lower end of the guide bore of said closing head that extends across but is spaced from said die face, said closing cap including a second flow opening therein for the passage of the flushing agent, the flushing agent being fed to said second flow opening in the closing cap so that the agent flows past said die face, through said gap space and then into the interior space of the closing head and past and around the spring means and out through said first flow opening.

6. The process of claim 2, including securing a closing cap to a lower end of the guide bore of said closing head that extends across but is spaced from said die face, said closing cap including a second flow opening therein for the passage of the flushing agent, the flushing agent being fed to said first flow opening so that the agent first flows into and through said interior space and past and around said spring means, then through said gap space and past said die face and then out through said second flow opening in the closing cap.

7. The process of claim 1, wherein the gap space between the die and the wall of the guide bore is larger at the end of the gap space adjacent the die face than at the end adjacent the interior space.

8. The process of claim 1, wherein the gap space includes at least one flow passage larger than said gap space that extends the length of said guide bore between said die face and said interior space.

9. The process of claim 1, wherein said die has a projection opposite said die face that extends through said interior space of said closing head, said first flow opening being located at an upper end of said projection opposite from said die face with a passage extending through said die and projection that communicates said first flow opening with the die face, the process including securing a closing cap to a lower end of the guide bore of said closing head that extends across but is spaced from said die face, said closing cap including a second flow opening therein for the passage of the flushing agent that communicates with said gap and a third flow opening therein that communicates with said passage, said flushing agent being fed first to said second flow opening so that the agent flows through said gap space and up into the interior space and past and around said spring means, then passing into said first flow opening and down through said projection and out through said third flow opening in the closing cap.

10. The process of claim 1, wherein said die includes a projection opposite said die face that extends through said interior space of said closing head, said first flow opening being located at an upper end of said projection opposite from said die face with a passage extending through said die and projection that communicates said first flow opening with the die face, the process including securing a closing cap to a lower end of the guide bore of said closing head that extends across but is spaced from said die face, said closing cap including a second flow opening therein for the passage of the flushing agent that communicates with said gap and a third flow opening therein that communicates with said passage, said flushing agent being fed through the third flow opening to the end of the passage in the die face so that it flows up the passage and out of said first flow opening and down into said interior space and past and around said spring means and then down through the gap space between the die and the inner wall of the guide bore and out through said second flow opening in the closing cap.

11. The process of claim 2, wherein said die has a projection opposite said die face that extends through said interior space of said closing head and a flow passage extending through said die and projection from the die face to an upper end of the projection opposite said die face, said flow passage at the upper end of the projection communicating with a second flow opening in the closing head, the process comprising securing a closing cap to a lower end of the guide bore of said closing head that extends across but is spaced from said die face, the flushing agent being fed to said first flow opening so that it flows first through said interior space and past and around the spring means, then down through the gap space between the die and the inner wall of the guide bore, across the die face and up the flow passage and out through said second flow opening.

12. The process of claim 2, wherein said die has a projection opposite said die face that extends through said interior space of said closing head and a flow passage extending through said die and projection from the die face to an upper end of the projection opposite said die face, said flow passage at the upper end of the projection communicating with a second flow opening in the closing head, the process comprising securing a closing cap to a lower end of the guide bore of said closing head that extends across but is spaced from said die face, the flushing agent being fed to said second flow opening so that it flows first down through said flow passage, across the die face and then up through the gap space and the interior space and past and around the spring means and out through said first flow opening.

13. A device for closing vessels with crown caps comprising a closing head having a sleeve at an upper end thereof forming an interior space, a guide bore at a lower end thereof communicating with said interior space, a die slidably mounted in said guide bore having a die face at its lower end and spring means mounted in said interior space, the die face being adapted to press a crown cap over an opening of a vessel against the force of the spring means as the closing head is moved relative to the vessel, a gap space being provided between the die and an inner wall of the guide bore that communicates with said interior space and a first flow opening being provided in the closing head that communicates with said interior space for passing a flushing agent in one direction through said first flow opening, the interior space and past and around the spring means mounted therein and then through the gap space from the upper end to the lower end of the closing head or in the reverse direction.

14. The device of claim 13, wherein the first flow opening is in a wall of the sleeve at an end of the interior space opposite from said die.

15. The device of claim 13, including a projection on the die opposite said die face that extends through said interior space of said sleeve toward the upper end of the sleeve of the closing head, a passage extending through said die and projection that communicates the die face with an upper end of said projection opposite from said die face, said upper end being slidably mounted in a sealed manner in an upper end of the closing head, and a second flow opening in said closing head communicating with the passage in the upper end of the projection, so that, when a closing cap is secured to the lower end of the guide bore that extends across but is spaced from the die face, a flushing agent can be passed in one direction through the first flow opening, down through the interior space and past and around the spring means mounted therein, through the gap space, across the die face and up the passage and out through the second flow opening or in the reverse direction.

16. A device for closing vessels with crown caps comprising a closing head having a sleeve at an upper end thereof forming an interior space, a guide bore at a lower end thereof communicating with said interior space, a die slidably mounted in said guide bore having a die face at its lower end and spring means mounted in said interior space, the die face being adapted to press a crown cap over an opening of a vessel against the force of the spring means as the closing head is moved relative to the vessel, a gap space being provided between the die and an inner wall of the guide bore that communicates with said interior space and a projection on the die opposite said die face that extends through said interior space of said sleeve toward the upper end of the sleeve, a passage extending through said die and projection that communicates the die face with an upper end of said projection opposite from said die face, said passage opening into said interior space for passing a flushing agent, in one direction, upwardly through said gap space and into said interior space and past and around said spring means mounted therein, then into said passage opening and downwardly through said passage and out said die face or in the reverse direction.

17. The device of claim 13, wherein the die has a polygon-shaped cross-section at least adjacent the gap space forming flattenings on its circumference that connect the interior space with the gap space.

18. The device of claim 13, wherein the die has on its circumference at least one groove extending in the longitudinal direction of the die that forms a flow duct connecting the interior space with the gap space.

* * * * *